US006732454B2

(12) United States Patent
Anderson et al.

(10) Patent No.: US 6,732,454 B2
(45) Date of Patent: May 11, 2004

(54) APPARATUS FOR EXTRACTING SOLVENT FROM A MASS OF VEGETABLE PARTICLES

(75) Inventors: George E. Anderson, Champlin, MN (US); Daniel D. Anderson, Stacy, MN (US); Richard W. Ozer, Golden Valley, MN (US); Floyd C. Teeter, Jr., Woodbury, MN (US)

(73) Assignee: Crown Iron Works Company, Roseville, MN (US)

( * ) Notice: Subject to any disclaimer, the term of this patent is extended or adjusted under 35 U.S.C. 154(b) by 0 days.

(21) Appl. No.: 10/282,642

(22) Filed: Oct. 29, 2002

(65) Prior Publication Data

US 2003/0140520 A1 Jul. 31, 2003

Related U.S. Application Data

(60) Provisional application No. 60/341,440, filed on Oct. 30, 2001.

(51) Int. Cl.[7] ..... F26B 17/00

(52) U.S. Cl. ..... 34/576; 34/218; 34/165; 99/495; 554/8

(58) Field of Search ..... 34/576, 218, 224, 34/225, 235, 236, 147, 165; 554/8, 9; 99/495

(56) References Cited

U.S. PATENT DOCUMENTS 3,717,440 A * 2/1973 Cannon ..... 23/284
4,308,103 A * 12/1981 Rotter ..... 202/117
4,683,665 A 8/1987 Geelen ..... 34/65
5,041,245 A 8/1991 Benado ..... 260/412.1
5,375,342 A 12/1994 Giesler ..... 34/168
5,783,243 A 7/1998 Benado ..... 426/425
6,066,350 A 5/2000 Purtle et al. ..... 426/430
6,233,842 B1 5/2001 Geelen ..... 34/360

* cited by examiner

*Primary Examiner*—Henry Bennett
*Assistant Examiner*—Camtu Nguyen
(74) *Attorney, Agent, or Firm*—Nawrocki, Rooney & Sivertson, P.A.

(57) ABSTRACT

A system for removing from a particle mass a liquid permeating the particle mass includes a vaporizing stage having a space wherein the pressure is less than the pressure of the particle mass. As the particle mass enters the vaporizing stage, the lower pressure causes much of the liquid to vaporize. Once vaporized, the vapor can be removed with a pump. A first stripping stage receives the particle mass from the first stage at a first particle inlet port and discharges the particle mass at a first particle outlet port. A first stripping gas inlet near the first particle outlet port of the first stripping stage injects an inert stripping gas into the particle mass. The inert gas mixes with remaining elements of the liquid and any entrained gas formed by the liquid, and the mixture is discharged at a gas outlet near the first particle outlet port. A second stripping stage having construction and operation different from the first stripping stage may receive the particle mass. In a preferred embodiment, at least one of the stripping stages transports the particle mass through gravitational force.

17 Claims, 1 Drawing Sheet

APPARATUS FOR EXTRACTING SOLVENT FROM A MASS OF VEGETABLE PARTICLES

This is a regular application filed under 35 U.S.C. §11(a) claiming priority under 35 U.S.C. §119(e)(1), of provisional application Serial No. 60/341,440, having a filing date of Oct. 30, 2001, which was filed pursuant to 35 U.S.C. §111(b).

BACKGROUND OF THE INVENTION

Many oilseed grain products such as corn, sunflowers, and soybeans, and other types of vegetable products such as cocoa (referred to hereafter generally as products), have a substantial vegetable oil component. Often, this oil is extracted at some point while processing the raw products. The oil itself is often a valuable commercial material used in foods, plastics, etc. The solids remaining after extracting the oil are also valuable and can be used for both human and animal foods, as well as for other purposes. The process to be described was developed to form a part of a process for extracting cocoa oil from raw cocoa, but may be used in other vegetable oil extraction processes as well.

Early steps in the processing grind or otherwise change the form of the raw product to flakes, powder, or other types of particulate material. This particulate material is still permeated with most of the original natural oil. The oil is then extracted from this particulate material.

A number of different processes for removing or extracting the oil from this particulate material have been developed. The type of oil removal process of interest here is termed solvent extraction. After the raw product has been converted to particles, the particles are immersed in a hydrocarbon liquid solvent such as hexane, heptane, isohexane, butane, or any similar petroleum-based solvent that dissolves the oil.

Upon immersing the particles, the solvent forms a liquid solution with the oil in the particles. The oil-solvent solution is then removed from the particles in some manner, by for example, pressing or even simple gravity draining. In gravity draining, a screen supports the particulate material and allows the oil-solvent solution to drain through the screen to a catch basin. The solvent and oil are then separated with a conventional process. Usually, the solvent recovered during this separation step can be used again in the extraction process.

When extracting oil from certain kinds of products, such as flaked or ground cocoa, one process uses butane in a pressurized chamber to dissolve the oil. When pressurized at room temperature to perhaps 3.5 bars (50 psi.), butane is a liquid. At one atmosphere and room temperature, butane is a gas, well known as the fuel for backyard grills around the country. It is convenient for this process that the solvent (butane, e.g.) be a liquid at moderate pressure and room temperature, and a gas at room pressure, but the process can be used, less conveniently, with solvents other than butane that liquefy at different pressures or temperatures. Whatever solvent one chooses should not liquefy at a pressure or temperature that may change the properties of the product particles in an undesirable way. The solvent will be usually referred to hereafter as butane, but the processes should be understood to operate with a number of solvents that dissolve the product oil and have a liquid-gas phase change compatible with room temperature and pressure.

The pressurized butane solvent liquid forms a solution with the oil in the product, which can be drained from the flaked or ground product. Several stages of pressurized solvent extraction may be used to remove nearly all of the oil from the product particles. Depressurizing the butane-oil solution obtained in each stage boils off the butane which can then be reclaimed. The remaining oil can be used as a food constituent or for other purposes.

After the oil-solvent solution has been drained from the cocoa particles in the last stage, there is usually a significant amount of solvent still permeating the cocoa particles, perhaps 30% by weight, and a trace amount of oil. Where the particulate material will be used as human food or animal feed, it is important for a number of reasons to remove nearly all of the solvent from the particulate material.

First, the solvent may be toxic, so removing the solvent from the particulate material prevents harm to whomever or whatever might consume the end product of the process. Secondly, whether the solvent is toxic or not, it may be an air pollutant so it's important to prevent as much of the solvent as possible from reaching the atmosphere. Third, the solvent is valuable. Extracting it from the particulate material allows its reuse in the oil extraction process.

U.S. Pat. No. 5,630,911 (Kratochwill) discloses apparatus and process for removing a substantial amount of the remaining solvent following gravity draining or other type of oil-solvent removal. The Kratochwill apparatus uses, within an enclosed vessel or volume, a number of inclined conveyors that carry the particulate material over heating plates. The particulate material permeated by the solvent still present is heated to vaporize the solvent. This solvent vapor can then be removed from the enclosed space. Some oil remains in the particulate material, but it forms a small percentage of the total mass. Kratochwill is incorporated by reference into this application.

One feature of the Kratochwill apparatus is that the process occurs at a temperature high enough to reduce the protein dispersability index (PDI) of particulate material having high protein content. A high PDI is preferred for some processed oilseed materials; for these materials, lower process temperature is an advantage.

BRIEF DESCRIPTION OF THE INVENTION

A system for removing from a particle stream, a liquid such as a solvent that permeating the particle stream has at least two stages. The system includes a first vaporizing stage having a chamber where the pressure is maintained lower than the pressure of the entering particle mass. As the particles enter the chamber of the vaporizing stage, the lower pressure causes much of the liquid to vaporize. A pump removes the vapor, thereby maintaining the lower pressure in the vaporizing stage chamber.

A first stripping stage receives the particles from the first stage at a first particle inlet port and discharges the particles at a first particle outlet port. A first stripping gas inlet near the first particle outlet port injects an inert stripping gas into the particles. The inert gas mixes with remaining elements of the liquid and any entrained gas formed by the liquid, and the mixture is discharged at a gas outlet near the first particle outlet port.

A second stripping stage may also be present to receive the particle mass from the first stripping stage. The second stripping stage may have a construction different from the first stripping stage. In one embodiment, at least one of the stripping stages, preferably the second, transports the particle mass through gravitational force.

In one embodiment, the second stripping stage comprises a fluid removal chamber having a cylinder to be mounted in an approximately upright position. The cylinder has an enclosed passage from an upper opening to a lower opening. The cylinder has adjacent to the lower opening, a gas inlet into which an inert gas such as nitrogen can be introduced. We use the term "cylinder" here to mean any sort of hollow chamber having a cross section approximately constant along its axis. The cross section is often circular, but can also be square or other convenient shape. We intend the term "cylinder" to include chambers whose cross section varies somewhat along the axis, say where the chamber cross section tapers to become smaller toward the lower opening.

A particle outlet port forms a part of the lower opening of the cylinder. The particle outlet port regulates flow of particles from the cylinder at a predetermined flow rate. A source of pressurized inert gas is to be connected to provide pressurized gas to the gas inlet.

DESCRIPTION OF THE PREFERRED EMBODIMENT

Figure 1:
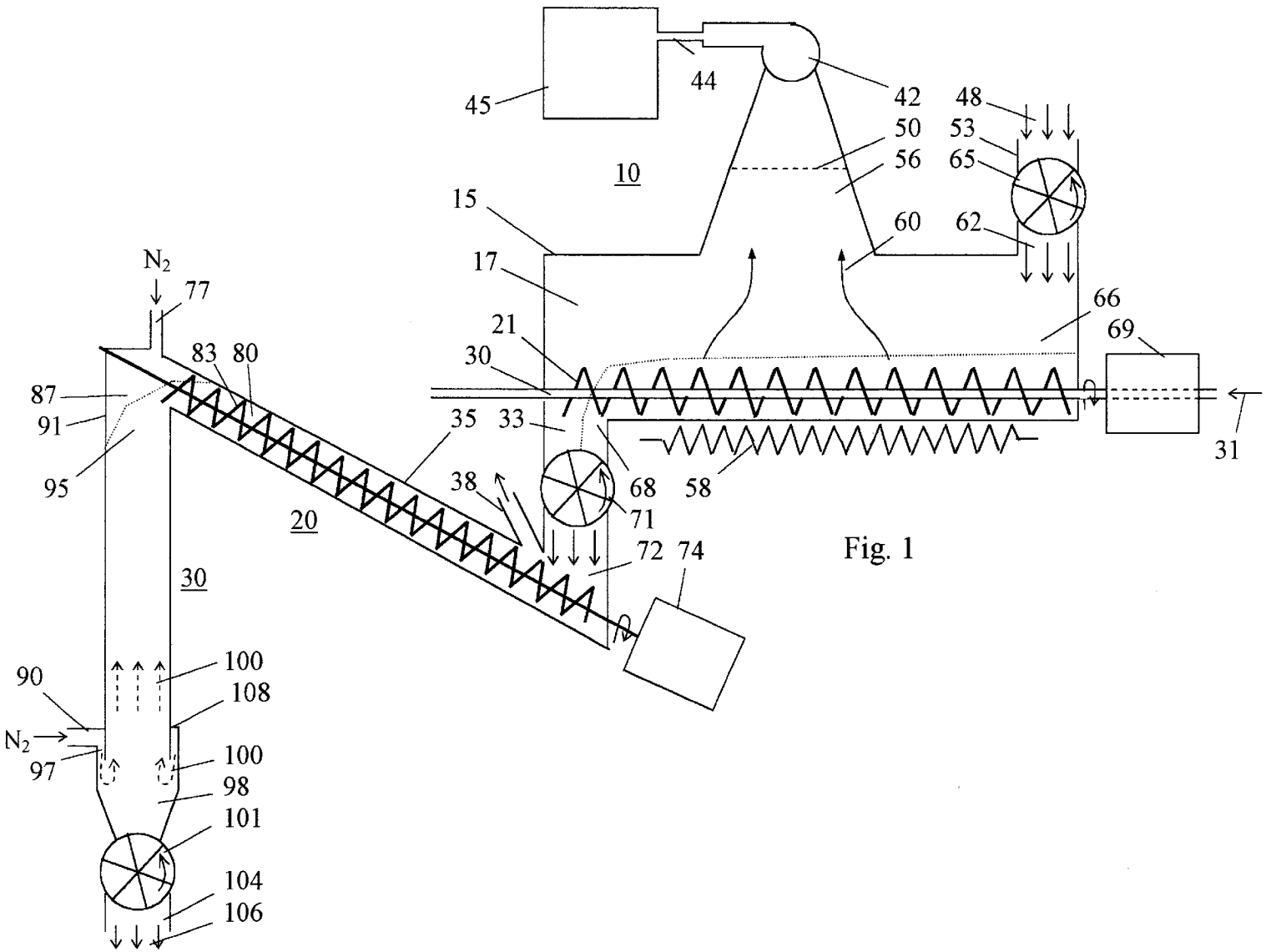
FIG. 1 shows a two dimensional diagram of a system built according to the invention, for removing a liquid such as a solvent from a stream of particles.

FIG. 1 shows a system for removing a liquid such as a solvent permeating a mass of product particles, typically flowing in a stream. The system employs first, second, and third stages 10, 20 and 30 to progressively remove a percentage of a liquid remaining in a mass of product particles such as cocoa particles. Very little of the liquid remains in the particles at the end of the third stage. The description following is for a system intended to remove a liquid such as pressurized butane or other solvent from a stream 48 comprising cocoa particles, but similar systems can be used to remove other types of liquids from other types of particles.

The first stage 10 uses a vaporizing process to remove a large amount of the solvent initially present in the particle stream 48. A pump 42 constantly removes this vaporized solvent.

The second and third stages each use a stripping process to remove remaining solvent carried in the particle stream 48. Stripping is carried out by forcing an inert or other gas through a chamber substantially filled with a part of the particle stream 48. The inert gas mixes with and if necessary vaporizes much of the remaining solvent, and sweeps the solvent vapor from the particle stream 48.

Structure

The particle stream 48 enters inlet port 53 of a rotary valve or airlock 65. Stream 48 flows from earlier process steps operating at a high pressure relative to the pressure in stages 10, 20 and 30. As mentioned in the Background section, this pressure may be in the range of 50 psi. at room temperature. These earlier steps have removed most of the oil in the particles but have left a relatively large amount of liquid solvent permeating the particle stream 48. One set of earlier process steps provides a particle stream 48 that is 30% liquid solvent by weight, but for desolventizing, this system may operate with varying concentrations of solvent.

Rotary valve 65 controls the flow rate of particle stream 48 from port 53 to an inlet port 62 of a first stage chamber 15. Valve 65 is a conventional device having a number of radially extending walls defining pie-shaped chambers between them. A central shaft is attached to the inner edges of the radial walls and in use is rotated as shown by the arrow, by a motor not shown. As the valve 65 rotates, particles in stream 48 fall into the individual chambers of valve 65 and are conveyed to inlet port 62. The particles passing through valve 65 fall through port 62 to the bottom of chamber 15 and form a particle mass 66.

Valve 65 opposes leakage of fluids and particles in stream 48 from inlet port 53 to inlet port 62, other than fluid and particles carried in the chambers of valve 65. The speed at which valve 65 rotates and the size of the individual chambers control the rate of particle flow into chamber 15. One finds that a certain amount of leakage of at least fluids through these rotary valves is usual.

An auger 21 carried on shaft 30 is mounted near the floor of chamber 15 and is rotated by a motor 69. The floor of chamber 15 may be shaped to cooperate with auger 21. As auger 21 rotates, particles forming particle mass 66 are simultaneously agitated and conveyed or transported toward an outlet port 33 of chamber 15.

Auger 21 may have a pitch and rotational speed to provide a transport time for particle mass 66 from the inlet port 62 to the outlet port 33 of around two minutes. The optimal transport time will vary depending on a number of factors, such as the type of material comprising particle mass 66, depth of particle mass 66, type of solvent, and size and shape of particles in particle mass 66.

A pump 42 draws gasses and vapors that form within chamber 15 through evaporation of solvent through a hood 56 and a filter 50 to maintain the pressure within chamber 15 substantially lower than the internal pressure level of the particle stream 48. The chamber 15 pressure should be held low enough to allow the liquid solvent in the particle stream 48 to vaporize within chamber 15 at a temperature that is easy to maintain. As this liquid solvent entrained in particle mass 66 vaporizes, pressure increases within chamber 15. Arrows 60 symbolize vapor removal from chamber 15 by pump 42 at a rate allowing much of the liquid solvent permeating particle stream 66 to vaporize during the transport of the particles in particle mass 66.

Pump 42 compresses the vaporized solvent and forces the solvent into tank 45 through pipe 44. Compressing the solvent vapor heats it, and cooling the solvent as it flows through pipe 44 reliquefies it. In most cases, pipe 44 should be a heat exchanger of some type to remove the heat from the solvent as it passes through pipe 44.

Particles from mass 66 may disperse into dust suspended in the gasses occupying the space 17 above particle mass 66 due to the impact of the falling particle stream at port 62, the boiling off of the solvent from the particle mass 66, and the agitation by auger 21. Filter 50 is provided to keep these particles from reaching pump 42.

A heat source, a part of which is shown generically as a heating element 58, supplies heat to chamber 17 to replace the heat taken up by the vaporizing solvent. In one version, auger 21 may be heated by the heat source as well as chamber 17. One way to heat auger 21 is by carrying auger 21 on a hollow shaft 30 as shown through which hot fluid 31 of some type is pumped.

As auger 21 rotates, particles in mass 66 are propelled toward an outlet port 33 of chamber 15, where they fall in a cascade 68 onto a second rotary valve 71. At outlet port 33, we find that in one design for stage 10 the particle stream 66 comprises perhaps 0.5% solvent by weight, the other 29.5% having boiled off within chamber 15. However, the remaining 0.5% solvent in the cascade 68 of particles still poses somewhat of a problem for some uses of the particles.

A first stripping chamber 35 provides a second stage of solvent removal. Particles in cascade 68 are carried through rotary valve 71 to an inlet port 72 of chamber 35. An auger 83 rotated by motor 74 transports the particle mass 80 to an outlet port 87, where the particle mass then falls by gravity through an inlet port 87 into a second stripping chamber 91. An optional inert stripping gas inlet 77 may be provided near the outlet of chamber 35. A suitable transport time for particles from inlet port 72 of chamber 35 to inlet port 87 of second stripping chamber 91 might be around 30 sec.

Second stripping chamber 91 serves as a third stage of solvent removal. Chamber 91 comprises an upright cylinder relatively tall compared to its width. During operation, a particle mass 95 formed from stream 48 at least partly fills chamber 91.

A sleeve or hopper 98 encloses the bottom opening of chamber 91, forming an annular opening 96 around the periphery of the lower end of chamber 91. A plenum 108 seals the interior of sleeve 98 against the outer surface of chamber 91. The gas inlet 90 near the top of sleeve 98 is to be connected to a pressurized source of a stripping gas. The seal between sleeve 98 and the outer surface of chamber 91 causes the inert gas to flow through the annular opening 96 into the particle mass 95.

In FIG. 1, the stripping gas is shown as nitrogen ($N_2$), but many other inert or even chemically active gasses may also be used, depending on the particular fluid permeating particle mass 95. Nitrogen is simply cheaper than other gasses, which is why we prefer it. The overlap between the bottom of chamber 91 and sleeve 98 prevents particle mass 95 from covering or sealing gas inlet 90. Pressurized stripping gas then flows as arrows 100 indicate through annular opening 96 into and through particle mass 95.

Sleeve 98 is shown with a cross section area reducing or tapered toward the bottom end. In one embodiment, this taper is sufficient to limit the flow of particle mass 95 through hopper 98. By restricting particle flow rate through sleeve 98, the height of particle mass 95 within chamber 91 stays at a substantial percentage of the total chamber height.

A particle flow control device of some kind, for example the rotary valve 101 shown, can be used to first of all, impound sufficient particles to form the particle mass 95 column within chamber 91, and then to control flow rate of particle mass 95 from sleeve 98. By varying the speed of rotation, valve 101 the particle volumetric flow rate can be adjusted. The volume flow rate for the particle stream 106 should, once steady state is reached, nearly equal the volume flow rate of particles at inlet port 87. Some simple flow control mechanism may be required to maintain a suitable height and flow rate for particle mass 95.

A transport time through third stage 30 on the order of a minute will strip a high percentage of the remaining solvent from mass 95. Using this criterion, to process about 130 tons/day (180 lb./min.) of a particle mass whose density is 30 lb./ft.$^3$, we suggest the following parameters for chamber 91 operation:

| | |
|---|---|
| Flow rate of particle mass 95 downward | 0.1 ft./sec. |
| Cross section area of chamber 91 | 1.0 ft.$^2$ |
| Upward flow velocity of stripping gas | 0.3 ft./sec. |
| Height of particle mass column in chamber 91 | 6.0 ft. |

Parameters for first and second stages 10, 20 can be easily derived to match these given for chamber 91.

Cocoa particles have a density of around 25–30 lb./ft.$^3$. Soybean meal density may be somewhat higher, perhaps 35 lb./ft.$^3$.

Explanation

Particle stream 48 having a relatively high pressure atmosphere passes through valve 65 to enter the relatively low pressure within first chamber 15. The lower pressure causes the entrained solvent to vaporize. Pump 42 removes the solvent vapor at a rate that maintains the pressure within chamber 15 at a level allowing continuous vaporization of the solvent. For a butane solvent entering inlet port 53 at 50 psi., pressure within chamber 15 may be held at approximately 15 psi. At the same time, the heating source 58 and the hot fluid 31 flowing through auger shaft 30 keep the particle mass 66 warm enough to support the boiling or vaporazation of solvent entrained in particle mass 66. Since the vaporization occurs at a relatively low temperature, the characteristics of mass 66 are not changed.

Motor 69 rotates auger 21 and shaft 30, transporting elements of particle mass 66 toward outlet port 30, and at the same time stirring particle mass 66 so as to aid vaporizing of solvent entrained in particle mass 66. By the time each element of particle mass 66 reaches the outlet port 33, much of the solvent initially entrained in that element has boiled off or vaporized. Speed of motor 69 may be such that the total transit time for most elements of mass 66 to cascade 68 from inlet port 62 is approximately two minutes. The depth of the mass 66 should not extend much above auger 21 as shown to assure thorough agitation and stirring of the mass 66 while moving toward outlet port 33.

For cocoa particles initially 30% solvent at inlet port 62, the solvent concentration may be reduced to about 0.5% at outlet port 33. However, this concentration may still be higher than desired for some particles composed of some types of materials.

Particles flow through second rotary valve 71 and enter second chamber 35 through inlet port 72. A second auger 83 transports particles toward inlet port 87 of third chamber 91 where they fall to become part of particle mass 95. Elements of particle mass 95 continuously flow through the bottom end of chamber 91 as stream 106.

During this time, pressurized stripping gas is introduced through inlet 90. This pressurized stripping gas flows or percolates first downwards through the annular opening 96 and then upwards through the particle mass 95, all as indicated by the dashed arrows 100. This flow of stripping gas sweeps almost all of the remaining solvent from particle mass 95. The solvent remaining in the particle mass 95 is displaced by the inert gas.

The flow velocity of the inert gas should not be so great as to cause the particle mass 95 column to fluidize, where particles are actually lifted from the top of particle mass 95. For typical vegetable-type particles, this means that the inert gas flow rate within the mass 95 should be less than about 2 ft./sec. At the same time, the flow velocity of the inert gas must be greater than the velocity downwards of the particle mass 95, so that the inert gas is continuously exiting from inlet port 87. The previously suggested flow velocities for the inert gas and particle mass 95 satisfy these requirements.

The pressure difference between particle inlet port 87 and gas inlet 90 affects the speed of gas flow rate in mass 95. The gas pressure at particle inlet port 87 is controlled by the pressure drop through second stage 20, the inert gas flow rate, and the pressure maintained at the gas outlet 38. Pressure drops through second and third stages 20, 30 are typically a few tenths of one psi. If outlet 38 flows directly to the atmosphere, the pressure at inlet 90 can be in the range of 0.5–1.0 psi.

The inert gas exits chamber 95 through particle inlet port 87 and continues to flow backwards through chamber 35 toward the inlet port 72 of chamber 35. Clearance between auger 83 and the inner wall of chamber 35 should be sufficient to allow this flow. Auger 83 constantly agitates and shifts particles within chamber 35, exposing individual particles in particle mass 80 to the flow of inert gas. The inert gas at inlet 87 has very little solvent gas mixed with it, since most of the solvent gas entrained in the particle mass at inlet 72 has already been swept from the particles during their transport through chamber 35. Therefore, the inert gas counterflowing through chamber 35 can still remove a large percentage of the solvent present in the particles within chamber 35 without adding further levels of stripping gas.

Solvent gas outlet 38 near the particle inlet port 72 allows the inert gas sweeping through chamber 35 to leave chamber 35. Since the amount of solvent in the particles within chamber 35 is actually quite low, the gasses exiting from outlet 38 it is usually quite safe to allowed their flow into the atmosphere. If not safe, it is easy to impound these gasses as done for stage 10 and remove any solvent vapor still in them. Using the same inert gas flow to strip solvent from both chamber 35 and chamber 91 reduces the amount of inert gas needed.

In some circumstances, the amount of gas provided at inlet 90 is not adequate to properly strip the solvent from the particles under transport in chamber 35. We show an optional inert gas inlet 77 for second stage 20. The gas at inlet 77 should be at a pressure somewhat less than the pressure at inlet 90 so as to assure that a constant reverse flow of inert gas through chamber 91 is present.

We find that for a particle mass comprising cocoa and a solvent such as butane, this three stage process can take particles having an initial 30% solvent concentration, and reduce the amount of solvent to perhaps one part in 100,000. Such a level is very likely to satisfy the most stringent requirements for solvent removal in human food.

The use of an auger 83 to transport particle mass 80 in an angled second stage 20 allows both first and third stages 10 and 30 to be located conveniently close to the ground. However, some variation in the selection of stripping stages 20 and 30 is possible. An auger can be used in third stage 30 rather than a columnar type of cylinder 91. It might even be possible to use two successive columnar cylinders as second and third stages 20, 30, but this would require locating stage 10 inconveniently far above the ground, or stage 30 below the ground.

The preceding describes our invention. What we wish to protect by Letters Patent is:

1. A system for removing from a particle mass, a fluid permeating the mass, said system including a source of pressurized gas for providing pressurized gas, said system comprising:

a) a source providing a flow of the particle mass;

b) a cylinder for mounting in an upright position, and having an enclosed passage from an upper opening to a lower opening, said cylinder's upper opening for receiving the flow of the particle mass, and said cylinder having a bottom portion defining a gas inlet adjacent to the lower opening, said gas inlet for connection to the source of pressurized gas; and c) a particle flow control device attached to the lower opening of the cylinder, said particle flow control device regulating flow of particles from the cylinder at a predetermined flow rate.

2. The system of claim 1, wherein the cylinder has an outer surface and the fluid removal chamber includes a sleeve having an inner surface, and fitting loosely around the cylinder's outer surface and overlapping the outer surface thereof, and defining the gas inlet as an annular gap between the cylinder's outer surface and the sleeve's inner surface, and wherein the sleeve includes a plenum sealing between the sleeve's inner surface and the cylinder's outer surface, and having a plenum port for connection to the source of pressurized gas.

3. The system of claim 1, wherein the particle flow control device comprises a rotary valve having an adjustable particle volumetric flow rate.

4. The system of claim 3, including an intermediate fluid removal chamber having an inlet port for receiving the flow of the particle mass, and an outlet port providing the particle mass flow to the cylinder's upper opening, and a second rotary valve receiving the particle mass flow from the particle mass source, said second rotary valve providing the particle mass flow to the intermediate fluid removal chamber inlet.

5. The system of claim 4, wherein the intermediate fluid removal chamber includes a second particle transporter transporting to the intermediate fluid removal chamber outlet port the particle mass provided to the intermediate fluid removal chamber inlet port, said intermediate fluid removal chamber inlet port further having a gas outlet port adjacent to the intermediate fluid removal chamber inlet port.

6. The system of claim 5, wherein the intermediate fluid removal chamber includes a gas inlet port adjacent to the particle outlet port.

7. The system of claim 5, including an initial fluid removal chamber comprising the particle mass source and having:

a) a particle inlet port for receiving from a pressurized chamber, particles carrying a liquid at the pressure in the pressurized chamber and gaseous at the pressure in the initial fluid removal chamber, said initial fluid removal chamber particle inlet port including a pressure dropping feature dropping the particle mass pressure from the pressurized chamber to the initial fluid removal chamber;

b) a particle outlet port connected to the intermediate fluid removal chamber;

c) a gas outlet port communicating with the initial fluid removal chamber and passing vaporized solvent from the initial fluid removal chamber; and d) a first particle transporter moving particles to the initial fluid removal chamber particle outlet port from the initial fluid removal chamber inlet port.

8. The system of claim 7, including a heat source supplying heat to the initial fluid removal chamber.

9. The system of claim 8, wherein the initial fluid removal chamber transporter comprises at least one of an auger and a conveyor.

10. The system of claim 9, including a connection from the heat source to the initial fluid removal chamber transporter.

11. The system of claim 10, including a pump connected to receive vaporized fluid from the initial fluid removal chamber gas outlet port.

12. The system of claim 7, including a pump connected to receive vaporized fluid from the initial fluid removal chamber gas outlet port.

13. The system of claim 12, including a rotary valve connecting the initial fluid removal chamber particle outlet port to the intermediate fluid removal chamber inlet port.

14. A system for removing from a particle mass, a fluid permeating the mass, said system including a source of pressurized gas for providing pressurized gas, said system comprising:

a) a first chamber receiving the particle mass at an inlet port and providing a continuous flow of the particle mass at an outlet port;

b) a second stage fluid removal chamber comprising a cylinder for mounting in a substantially upright position, and having an enclosed passage from an upper opening to a lower opening, said cylinder's upper opening for receiving flow of the particle mass from the first chamber, and said cylinder having a bottom portion defining a gas inlet adjacent to the lower opening, said gas inlet for connection to the source of pressurized gas; and c) a particle flow control device attached to the lower opening of the cylinder, said particle flow control device regulating flow of particles from the cylinder at a volume flow rate nearly equaling the volume flow rate at the upper opening.

15. The fluid removal system of claim 14, wherein the first chamber includes a gas outlet adjacent to the first inlet.

16. The fluid removal system of claim 15, wherein the first chamber includes a particle mass transporter moving the particle mass from the inlet port to the outlet port.

17. The fluid removal system of claim 16, wherein the particle mass transporter comprises an auger.

* * * * *